US007121051B2

(12) United States Patent
Hunsaker

(10) Patent No.: US 7,121,051 B2
(45) Date of Patent: Oct. 17, 2006

(54) PANEL FOR THIN BRICKS AND RELATED SYSTEMS AND METHODS OF USE

(76) Inventor: Garrick Hunsaker, 1058 W. Corral Cir., West Jordan, UT (US) 84088

( * ) Notice: Subject to any disclaimer, the term of this patent is extended or adjusted under 35 U.S.C. 154(b) by 7 days.

(21) Appl. No.: 10/364,182

(22) Filed: Feb. 10, 2003

(65) Prior Publication Data

US 2003/0121225 A1 Jul. 3, 2003

Related U.S. Application Data

(63) Continuation-in-part of application No. 09/781,350, filed on Feb. 12, 2001, now Pat. No. 6,516,578.

(51) Int. Cl.
*E04C 1/00* (2006.01)

(52) U.S. Cl. ..... 52/314; 52/311.3; 52/315; 52/384; 52/387; 52/389; 52/391; 52/745.19; 52/747.11; 52/747.12; 52/747.13

(58) Field of Classification Search ..... 52/311.1, 52/314, 315, 344, 363, 384, 385, 386, 387, 52/389, 390, 509, 745.1, 745.13, 745.19, 52/747.11, 747.12, 582.1, 589.1, 591.1, 592.1, 52/747.13, 311.3

See application file for complete search history.

(56) References Cited

U.S. PATENT DOCUMENTS

| | | | | |
|---|---|---|---|---|
| 1,926,257 | A * | 9/1933 | Bawtenheimer | 52/386 |
| 2,198,466 | A * | 4/1940 | Stolze | 52/385 |
| 2,392,232 | A | 1/1946 | Crafton | |
| 2,419,047 | A * | 4/1947 | Young | 52/314 |
| 3,304,673 | A * | 2/1967 | Ramoneda | 52/220.3 |
| 3,740,910 | A | 6/1973 | Taylor et al. | |
| 3,740,911 | A | 6/1973 | O'Leary | |
| 3,908,326 | A * | 9/1975 | Francis | 52/384 |

(Continued)

OTHER PUBLICATIONS

*Western Thin Brick and Tile*, brochure, (printed before Feb. 12, 2001).

(Continued)

*Primary Examiner*—Carl D. Friedman
*Assistant Examiner*—Yvonne M. Horton
(74) *Attorney, Agent, or Firm*—Stoel Rives LLP

(57) ABSTRACT

A thin brick panel system and method of forming a thin brick wall includes an expanded polystyrene foam panel having a plurality of laterally extending channels formed therein for receiving a plurality of thin brick units. The thin brick units are bonded to the channels in the foam panel and the seams between adjacent bricks are filled with a mortar that bonds to the foam panel. The foam panel may be attached to a substrate with an adhesive as well as fasteners. Strips of a mesh fabric may span several panels to bind the panels together to form a structurally sound thin brick wall.

2 Claims, 5 Drawing Sheets

U.S. PATENT DOCUMENTS

| | | | | |
|---|---|---|---|---|
| 4,011,702 | A | 3/1977 | Matyas | |
| 4,241,554 | A | 12/1980 | Infantino | |
| 4,299,069 | A * | 11/1981 | Neumann | 52/309.4 |
| 4,407,104 | A | 10/1983 | Francis | |
| 4,589,241 | A | 5/1986 | Volpenhein | |
| 4,662,140 | A | 5/1987 | Porter et al. | |
| 4,809,470 | A | 3/1989 | Bauer et al. | |
| 4,956,949 | A | 9/1990 | Francis | |
| 5,228,937 | A | 7/1993 | Passeno | |
| 5,311,714 | A | 5/1994 | Passeno | |
| 5,373,676 | A | 12/1994 | Francis et al. | |
| 5,501,049 | A | 3/1996 | Francis et al. | |
| 5,526,630 | A | 6/1996 | Francis et al. | |
| 6,164,037 | A | 12/2000 | Passeno | |
| 2003/0213212 | A1 * | 11/2003 | Passeno | 52/745.19 |

OTHER PUBLICATIONS

*Harristone*, G.S. Harris Co., Inc. brochure, (printed before Feb. 12, 2001).

*US Brick Systems*, Installation Guide and Details, brochure (printed Jul. 1999).

*US Brick Systems*, brochure, (printed before Feb. 12, 2001).

*Cultured Stone Product Selection Guide*, brochure (printed 1999).

* cited by examiner

PANEL FOR THIN BRICKS AND RELATED SYSTEMS AND METHODS OF USE

RELATED APPLICATIONS

This is a continuation-in-part of U.S. application Ser. No. 09/781,350, filed on Feb. 12, 2001 now U.S. Pat. No. 6,516,578.

TECHNICAL FIELD

The present invention relates generally to building materials and structures. More particularly, it relates to thin brick panel systems used on home and building facades.

BACKGROUND OF THE INVENTION

Architectural thin face brick, commonly referred to as "thin brick," is typically kiln-dried brick units that have height and width dimensions similar to those dimensions of conventional brick, but have a relatively small thickness. Thin brick systems are typically used as a decorative element to a new or existing architectural structure. These systems give structures the appearance of having "full" brick walls, while avoiding the associated expense. Many of these systems use a quick drying glue to adhere thin bricks to a foam panel. Mortar is then placed between the thin bricks to give the bricks structural integrity and to give the thin brick system the appearance of a full brick wall.

Problems have arisen in this art due to poor adhesion between the thin bricks and the foam panels. Prior thin brick systems have used various methods to increase the adhesive strength between the thin bricks and the foam panels. Some of these systems use foam panels with raised spacing members that form channels on the surface of the foam panels. The channels formed by the raised spacing members serve not only to align the thin bricks in a row, but also to snap into place and temporarily secure the thin bricks to the foam panel until mortar can be applied and dried. The height of the raised spacing members is less that the thickness of the thin bricks so that a small groove is formed on top of the raised spacing members and between the thin bricks. Mortar is applied to this area to secure the thin bricks into place.

One of the problems identified early on with these "friction-fit" or "snap-fit" systems is the limited surface area of the foam panels available for mortar bonding. That is, the mortar only makes contact with the tops of each laterally extending spacing member separating the thin bricks. This area of the foam panel is very small, and does not provide a strong bond between bricks and the panel. Due to natural elements and weathering, thin bricks of such systems may become unstuck from the foam panels, causing an uneven, warped brick surface. Further, in these systems very little force need be applied to crack the mortar and remove the thin bricks completely.

Some have tried to solve this problem by applying an adhesive to the brick to hold the brick to the foam panel. However, many strong adhesives disintegrate the polystyrene foam panel which is normally used in thin brick systems.

Thus it would be an advantage to provide a thin brick panel system that allows bonding of the mortar to the panel system without the need for additional structural support.

It would also be advantageous to provide a thin brick panel system which utilizes conventional adhesives to attach the brick to the panel system.

It would be another advantage to provide a panel system that prevents the brick and mortar attached thereto from being easily dislodged.

Moreover, it would be advantageous to provide a panel system that can readily utilize irregular shaped and/or sized thin bricks.

These and other advantages will become apparent from a reading of the following summary of the invention and description of the preferred embodiments in accordance with the principles of the present invention.

SUMMARY OF THE INVENTION

An object of the present invention is to provide a thin brick system facilitating a strong adhesive bond between the thin bricks and the foam panel by increasing the surface area of the thin bricks and foam panel available for contact with mortar.

Another object of the invention is to provide a thin brick system which has the flexibility to allow irregular sized and shaped bricks to be readily accepted and used by the system.

Accordingly, a thin brick panel system is provided, which comprises an expanded polystyrene foam panel having a front side and a back side. The front side defines a plurality of laterally extending channels. The channels are each defined by a pair of laterally extending spacing members or rails that are integrally formed with the panel. The panel is utilized to form a brick fascia on the exterior surface of a building or other structure. Of course, the system can be applied to new structures or existing structures. The panel system is configured to secure thin brick units to the building or structure in a manner that gives the appearance that full-sized bricks have been used. Use of a panel formed from expanded polystyrene instead of another material such as unexpanded polystyrene enables the channels to have irregular surfaces, which increases the surfaces area for bonding so that the adhesive can bond with optimal strength to the channels.

The thin brick units are inserted into the channels and each thin brick may rest on the laterally extending spacing member located at the bottom of each channel. A quick drying adhesive may be interposed between the brick units and the foam panel to bond the brick units directly to the foam panel. To further strengthen the bond between the thin bricks and the panel, mortar is introduced between the bricks. Because the height of the spacing members is less than the thickness of the thin bricks, mortar can be introduced on top of the spacing members and between the thin bricks. The top of the spacing members will preferably be flat or have a generally rectangular cross-section so as to maximize bonding with the mortar.

Moreover, the system is configured to provide for additional surface area for mortar bonding. The channels of the system are sized such that they are wider than the width of a typical thin brick. Accordingly, if the thin bricks are placed on the lower portion of the channels, for each normal brick there will be an open space between the top of the brick and the adjacent top spacing member. This space provides further surface area to which mortar can be applied. This increased surface area creates a strong bond between the mortar, the foam panel, and thin bricks, thereby remedying the problems seen in the prior art due to poor adhesion between thin bricks and foam panel. Not only do the wider channels provide advantageous bonding properties, but they also allow for the placement of irregular shaped and/or sized bricks, which cannot be used in snap-fit thin brick systems.

One embodiment of the panel system provides mating features along the side of the panel that mate with similar features of an adjacent panel. For example, the mating features could comprise a tongue and groove extending along opposing sides of each panel.

A mesh strip may be inserted into the channel between the base of the channel and each thin brick unit. The mesh strip extends to the channels of adjacent foam panels, binding together several panels. These mesh strips provide structural strength to the foam panels. The adhesive used to hold the bricks flows into and through the mesh strips to bond to the panel creating a strong bond between the panel, mesh, and bricks. A mechanical fastener, which secures the panel system to a substrate or existing structure, is also placed on top of the mesh strips within the channels. The mesh strips also provide structural integrity to the fastener.

Initially, the panel of the present invention may be attached to the existing structure with an adhesive or mechanical type fasteners as discussed. Obviously, such attachment is performed prior to application of the brick units to the panel. Thereafter, the mesh strips may optionally be applied to the panels using the mechanical fasteners and/or an adhesive as discussed above. An adhesive may then be applied to the panels to hold the thin bricks in place while the mortar is applied. The thin bricks are preferably placed onto the lower portion of the channel such that the bottom edge of each brick rests on the adjacent spacing member below. Then, the mortar can be applied not only to the top of each spacer, but also to the portion of the panel and space between each brick and the adjacent spacing member above.

Additional aspects and advantages of this invention will be apparent from the following detailed description of preferred embodiments thereof, which proceeds with reference to the accompanying drawings.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF PREFERRED EMBODIMENTS

Figure 1:
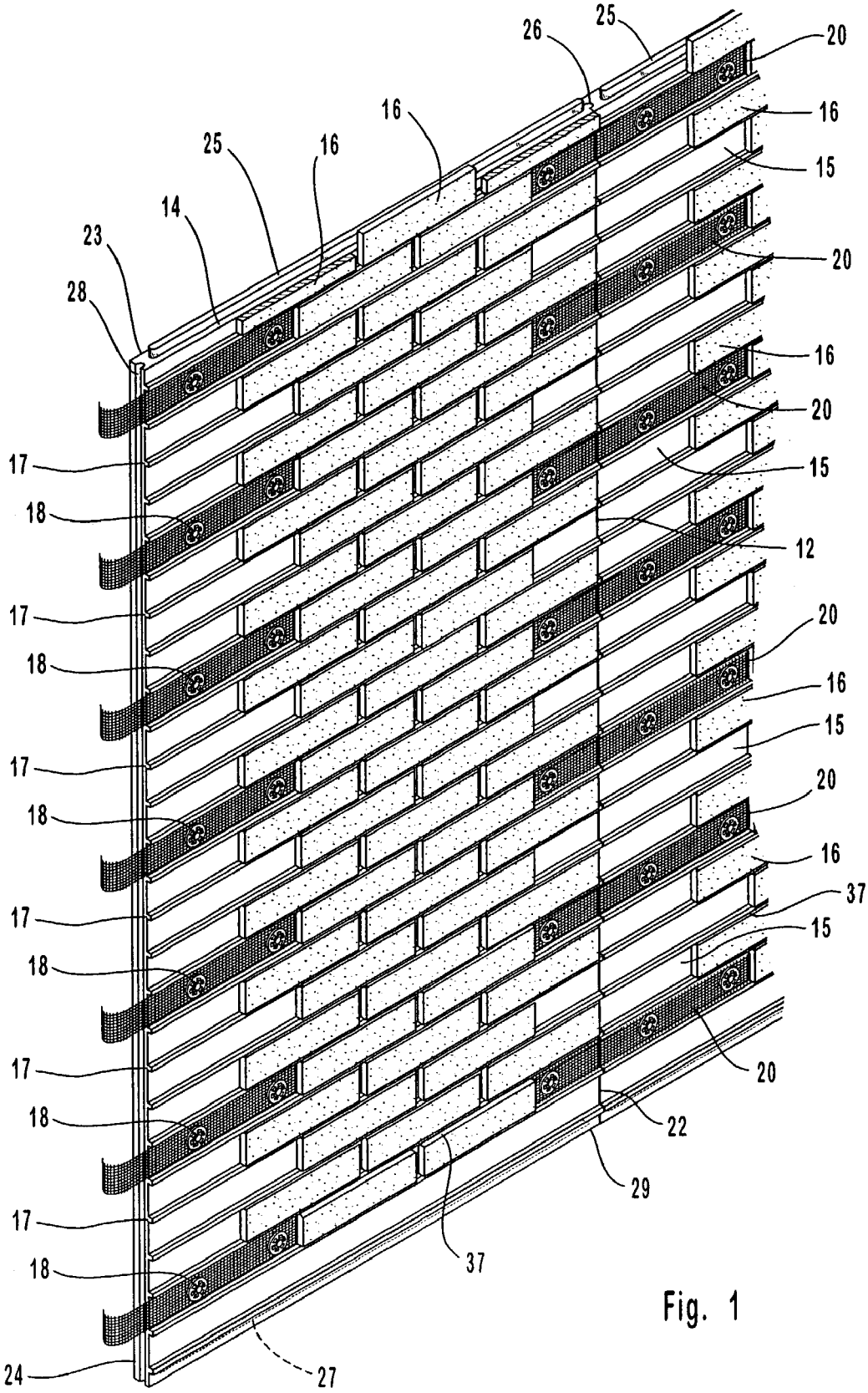
FIG. 1 is a perspective view of two panels for use in a thin brick panel system.

With reference to FIG. 1, the thin brick panel system of the present invention is indicated generally at 10. The system 10 is comprised of a panel 12, which may be formed from an expanded polystyrene insulation material, commonly referred to as beaded polystyrene foam, or the like. Expanded polystyrene panels provide for increased surface area for bonding between an adhesive, the thin brick units, and the panel. However, suitable panels for use in the system of the present invention may alternatively be formed from metals or other materials.

The foam panel 12 may be formed by cutting a sheet of expanded polystyrene foam, metal, or other material by any suitable means into the desired cross-sectional shape. Such material is flexible enough such that expansion and/or contraction due to temperature variations can be absorbed by the foam panel. In addition, beaded polystyrene foam can be manufactured in many shapes and sizes and does not have a thickness limitation, as is the case with extruded polystyrene foam products. Accordingly, the panel 12, while illustrated as generally comprising a "sheet" of material, may be formed into any shape or size depending on the needs of the user. For example, as will be described in more detail herein, the panel of beaded polystyrene foam may take into account the building for which the panel system 10 is to be applied. That is, if the structure has variations in its surface topography, the back side 14 of the panel 12 can be preformed to fit over such architectural features. Additionally, in situations where it is desirable to lay the thin brick 16 on the panel in a manner that creates various elevations in the brick panel surface, such elevations can be preformed into the panel. Thus, when a panel providing for various brick elevations is attached to an existing structure, the panel will space the thin brick 16 from the existing structure according to the architect's design without the need for additional materials.

It is contemplated that, while thin brick units 16 are shown in the depicted embodiments, other construction elements may be used in accordance with the present invention. For example, the panels could be configured to receive various other masonry materials, such as stone, rock, marble, and the like.

The panel 12 is formed with a plurality of channels 15, which preferably extend across the width of the panel 12. Channels 15 are defined by a plurality of laterally extending spacing members 17. Spacing members 17 are preferably integrally formed with panel 12—i.e., they are preferably cut directly into the sheet of expanded polystyrene foam. However, attached spacing members, attachable by any suitable means, are also within the scope of the invention. Channels 15 may optionally have a plurality of apertures formed therein, particularly for embodiments utilizing metallic panels.

Figure 2A:
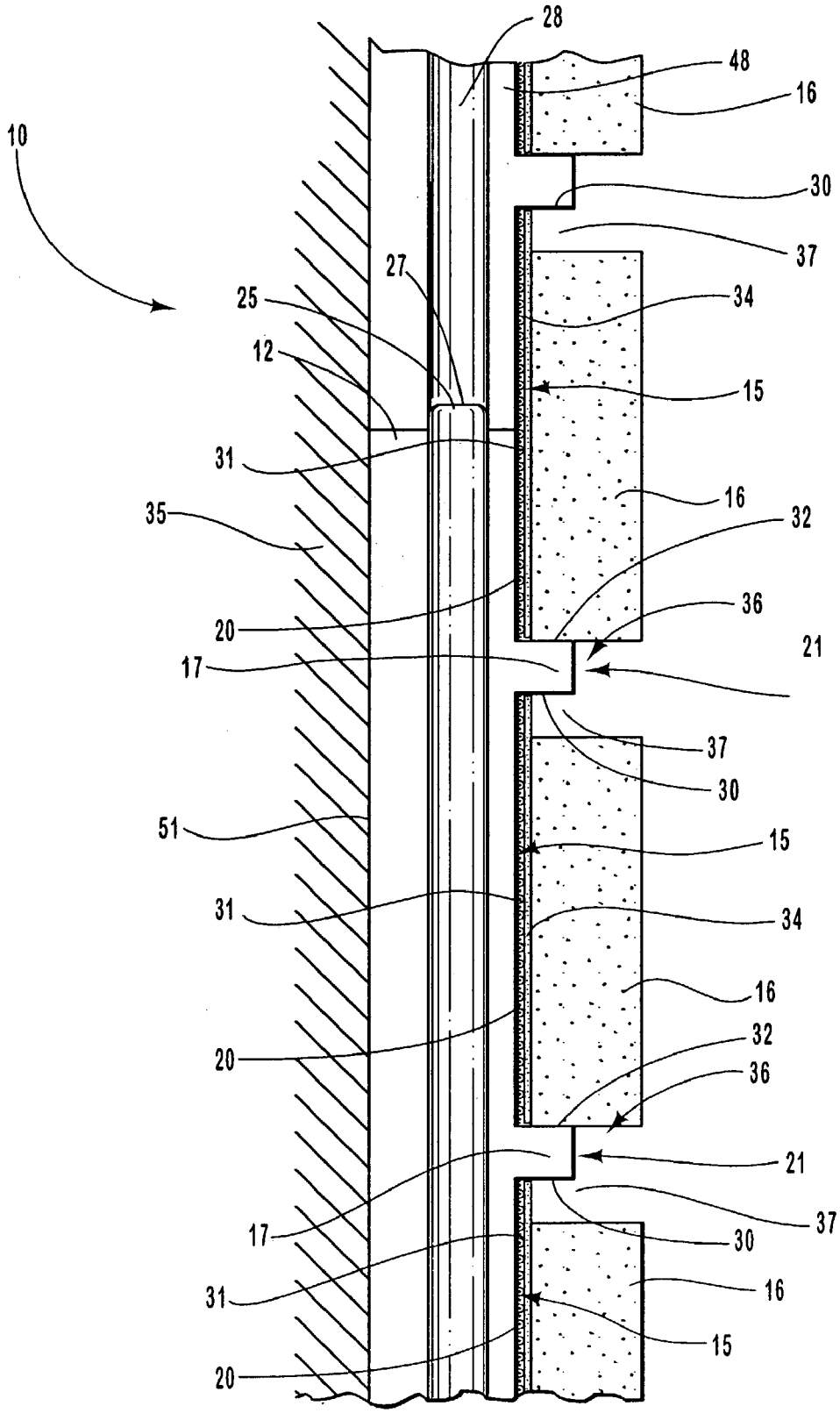
FIG. 2A is a side view of the thin brick panel.
Figure 2B:
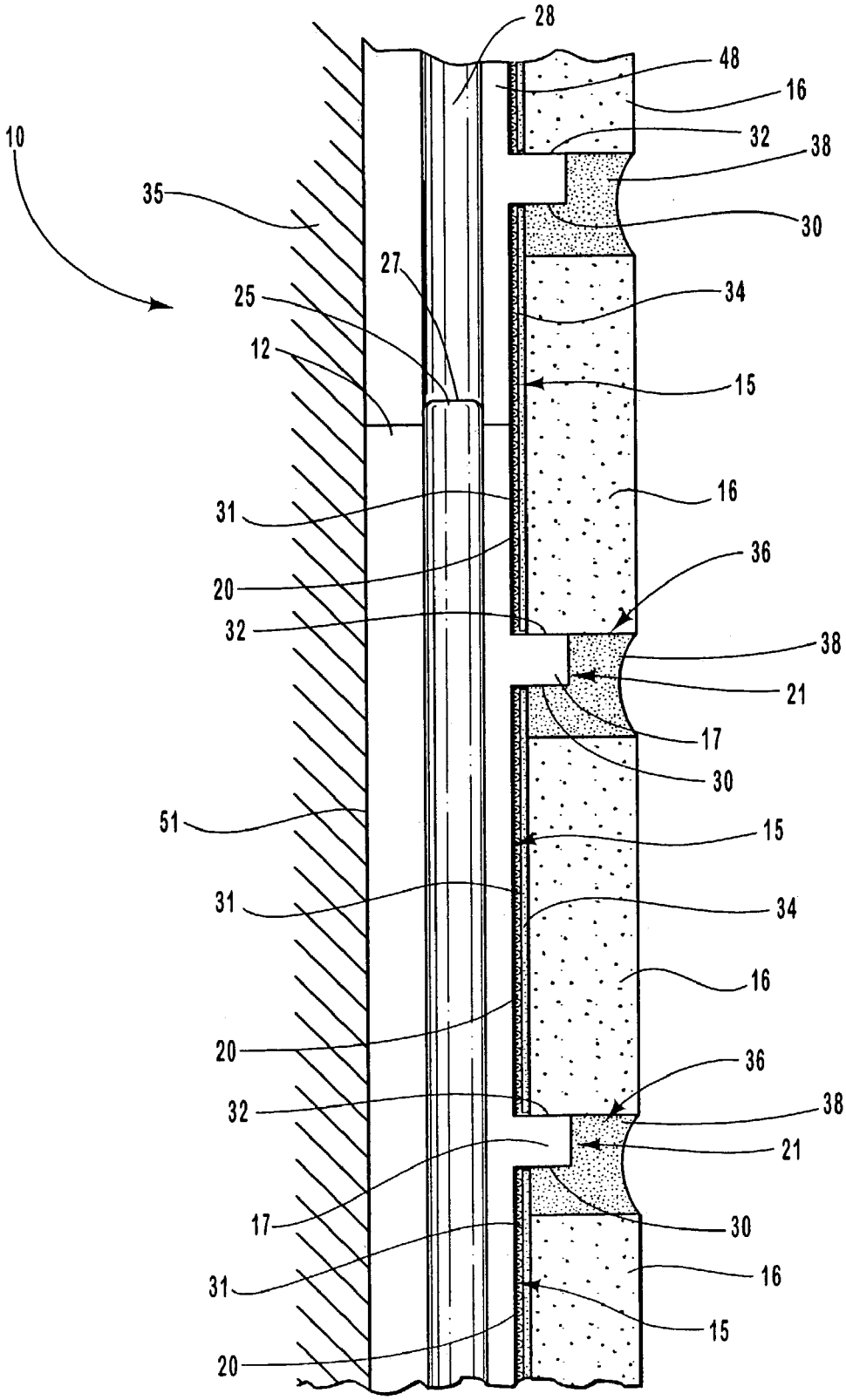
FIG. 2B is a side view of the panel shown in FIG. 2A with mortar bonding the thin brick units to the panel.

Spacing members 17 have a height that is less than the thickness of each brick 16. This allows for mortar to be introduced in the space between the top of spacing members 17 and the surface of bricks 16. In addition, channels 15 are configured such that they have a width greater than the width of a standard thin brick 16. Accordingly, if standard-sized bricks 16 are positioned on the lower portion of channels 15 a space 37 will be formed. If 2¼ inch thin brick units are used, the width of channels 15 will be about 2⅜ inches, thus allowing for a space 37 of about ⅛inch. However, as discussed later, the width of space 37, and the width of channels 15, may vary considerably. Space 37, as best seen in FIGS. 2A–2B, is defined by a spacing member 17 on one side, panel 12 underneath, and brick 16 on the other side.

Providing space 37 serves a number of purposes. First, space 37 allows the system to use bricks that are shaped or sized differently than standard bricks. For snap-fit systems, any brick units that are even slightly mis-shapen cannot be used and must be discarded. Likewise, brick units that are even slightly too small or too large will not be suitable for use in these systems. The present invention, on the other hand, due to the extra space provided in channel 15 by space 37, can incorporate bricks 16 that are mis-shaped, too large, or too small.

Moreover, space 37 provides an increased surface area for mortar bonding. As best seen in FIG. 2B, mortar 38 is applied to each space 37, as well as to the top of spacing members 17. For each space 37, mortar 38 contacts panel 12 at the portion of channel 15 defining space 37, at surface 30 of spacing member 17, and at surface 21 of spacing member 17. Furthermore, there is a larger surface area on the upper side of bricks 16, as also seen in FIG. 2B, that will be in contact with the mortar 38. As should be apparent, the increased surface area provided by space 37 for mortar bonding between the mortar 38, bricks 16, and panel 12, results in a much higher degree of structural strength than would otherwise be available.

Preferably, the width of space 37—i.e., the distance from the top edge of a brick 16 to surface 30 of the adjacent spacing member 17—will be in the range of about ⅛ of an inch to about ¼ of an inch. However, this width may be less than ⅛ of an inch, and may be greater than ¼ of an inch, depending on the configuration desired.

Each thin brick unit 16 is preferably adhesively attached to the panel 12 within channels 15. As mentioned, it is also preferable that when the bricks 16 are attached to the panel 12 they are positioned such that their lower edges rest on the spacing member 17 immediately below, such that spaces 37 are formed in the space above each brick 16. However, it is also possible to adhesively position the bricks such that the each brick's top edge abuts surface 30 of the adjacent spacing member 17 above, such that space 37 will be formed underneath each brick 16 instead of above them. As still another alternative, bricks 16 may be positioned in the center of channels 15 such that a space is formed above and below the bricks 16.

Referring now back to FIG. 1, the polystyrene foam panel may be mounted to an existing structure (not shown) with a plurality of fasteners 18. Fasteners 18 hold panel 12 firmly against the structure. These fasteners 18 will be discussed in greater detail in relation to subsequent figures.

A plurality of mesh strips 20 may also be employed to add further structural strength to the panel system 10. Mesh strips 20 can be made of any suitable fabric, fiberglass, or other material. Mesh strips 20 preferably span several adjacent panels 12 in order to bind them together, as shown in FIG. 1. In order to facilitate the binding of adjacent panels 12, it is preferable that the mesh strips 20 be kept tight, at least across the joint between adjacent panels. Mesh strips 20 also preferably have a width similar to the width of the channels 15 between adjacent spacing members 17. This allows the strips 20 to be placed along the channels 15 behind brick units 16. Mesh strips 20 may be placed in only some of the channels 15, as shown in FIG. 1, or they may be placed in every channel 15, as shown in FIGS. 2A–2B.

As seen in FIG. 1, mesh strips 20 are also placed behind mechanical fasteners 18. As such, mesh strips 20 help prevent the fasteners 20 from being pulled through the foam panel 12. In addition, if an adhesive is used to attach brick units 16 to the panel 12, the adhesive will become interlocked with the mesh strips 20, the bricks 16, and the panel 12, serving to provide a strong mechanical bond between the three.

To facilitate the attachment of adjacent panels 12, the sides 22 and 24 of the panel 12 may be provided with attachment features. In one embodiment of the system, the attachment features comprise tongue and groove features, 26 and 28 respectively, which preferably extend the length of each panel 12. As such, the tongue feature 26 of one panel 12 can be inserted into the groove feature 28 of an adjacent panel 12 during installation to help hold adjacent panels 12 together and maintain a substantially planar surface at the joint between adjacent panels 12. Such a surface at the joint is important in order to maintain a natural or "full" brick appearance to the finished structure. That is, it is highly desirable that the joint between adjacent panels 12 not be visually detectable after installation. To additionally further this goal, the system can be configured such that brick units 16 in every other row or channel 15 overlap with an adjacent panel 12. Not only does this assist in masking the seam between adjacent panels 12, but it also adds to the structural strength of the finished wall.

The panel 12 may also include tongue and groove features 25 and 27 along its top and bottom sides 23 and 29, respectively. Preferably, the tongue feature 25 is located on the top edge or side 23 so that when the bottom edge or side of an adjacent panel is abutted against the top side 23 of the panel 12, the tongue feature 25 fits within and thus mates with the groove feature of the adjacent panel (not shown). This arrangement is preferable because, in a situation where water may find its way behind the brick or at least into the seam formed between vertically stacked panels 12, the water will be encouraged to stay in front of the panel 12. That is, by providing the tongue feature 25 on the top 23 of the panel 12, water will not easily be able to flow over the tongue feature 25 to flow to the back side of the panel 12. Of course, the top and bottom sides of the panel may alternatively be flat.

It is preferable that the joint between vertically adjacent panels be positioned such that it does not coincide with a spacing member 17. The embodiment depicted in FIGS. 1 and 2A–2B has this joint positioned at approximately the mid-point of a thin brick unit 16. Although this joint could be positioned at a spacing member 17, because the mortar will be applied on the surface 21 of each spacing member 17, doing so may cause cracking at mortar joints under which panel joints are positioned. For this reason, it will often be preferable to configure systems of the present invention such that the joint between vertically positioned panels does not coincide with a spacing member 17. In other words, each panel will be configured such that it has at least one partial channel—at the top and/or bottom of the panel—that has a smaller width than the full channels. This allows the thin brick units to be applied to and be in contact with the partial channel and a similar partial channel of a vertically adjacent panel.

Referring now again to FIG. 2A, the brick units 16 are inserted within the channels 15 and preferably abut against the lower interior side 32 of each channel 15 (or the upper exterior side of each spacing member 17). An adhesive 31 may be applied to the bottom surface 34 of each channel 15 to hold the brick units 16 to panel 12. Because the panel 12 of the present invention is preferably formed from a beaded polystyrene foam, adhesives that are common in the construction industry may be applied directly to the panel 12 and will not affect the integrity of the panel 12. Such adhesives include polymer-based adhesives, such as those manufactured under the trademark DRYVIT®. These adhesives have conventionally been used on expanded polystyrene foam for stucco applications. Such an adhesive 31 may also be utilized to attach the panel 12 to a substrate, such as an existing structure 35.

Whereas the brick units 16 will typically be rested against surface 32 of the spacing members 17, if an adhesive 31 is used to affix the bricks 16 in the channels 15, the bricks 16 may be placed in other positions within the channels 15. For instance, the bricks 16 may be positioned within the upper portion of channels 15 such that they abut the upper interior side 30 of each channel (or the lower exterior side of each spacing member 17). Alternatively, brick units 16 may be placed centrally within each channel 15 such that a space is formed above and below each brick. Nevertheless, it is preferable that the brick units 16 abut one of the spacing members 17, either above or below them, and it is even more preferable that they abut the spacing member below. This is because the spacing members 17 also serve to align the bricks such that they are in a straight row, and this purpose is most easily served by resting the brick units 16 on the spacing member defining the lower end of each channel, or surface 32.

The lateral protrusions or spacing members 17 provide even spacing between the brick units 16. The spacing members 17 extend from the bottom surface 34 of each channel 15 to a height that is less than the thickness of the brick units 16. As such, a gap or seam 36 is formed between the top of the spacing members 17 and the sides of adjacent brick units 16. This gap 36 is filled with mortar 38 which bonds to the top of the spacing members 17 and the sides of the brick 16 to form a solid wall when complete, as seen in FIG. 2B. The mortar 38 may comprise a polymer-based mortar to ensure that the mortar 38 will bond to the panel 12.

In addition, as previously discussed, there will be a second gap or space 37 defined as seen in the cross-sectional view of FIGS. 2A–2B by three surfaces. From a cross-sectional perspective, these surfaces are surface 30 of each spacing member 17, bottom surface 34 of each channel 15, and the top edge surface of each brick unit 16. Of course, space 37 is present due to the fact that the width of channels 15 exceeds the width of brick units 16 to some degree. Again, mortar is filled not only in gap 36, but also in space 37. The additional surface area provided by space 37 allows for a much stronger mortar bonding effect than would exist without space 37.

As further illustrated in FIG. 2, a mating feature 25 in the form of a raised portion or tongue is formed preferably along the top surface 23 of the panel 12. As discussed with reference to FIG. 1, this mating feature 25 is configured to mate in a male/female relationship with a recessed mating feature or groove 27 preferably formed along the bottom of another panel 48. Like the lateral mating features, it is preferable that these vertical mating features maintain a substantially planar surface at the joint between adjacent panels.

Figure 3:
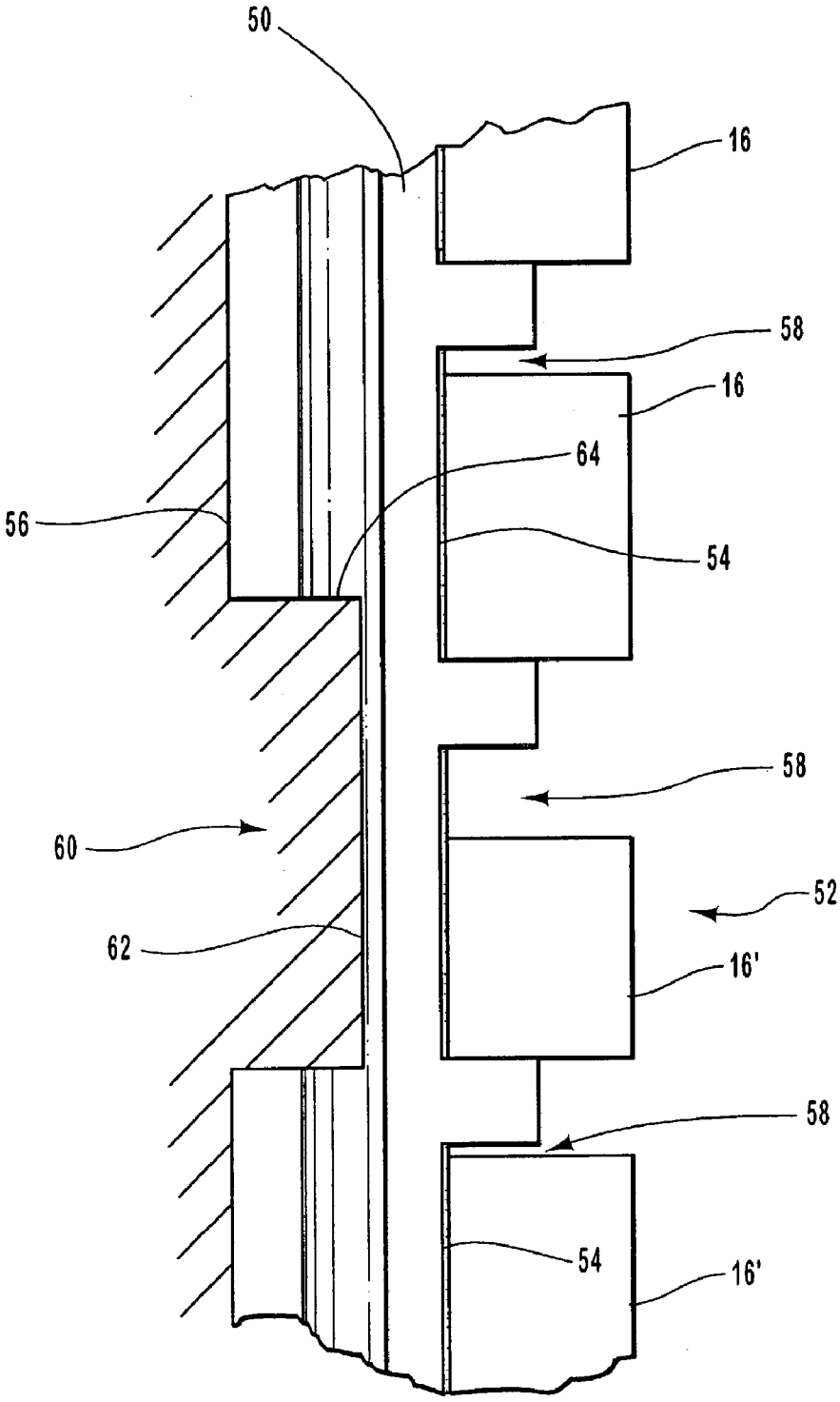
FIG. 3 is a side view of another embodiment of a thin brick panel.

FIG. 3 illustrates another embodiment of a foam panel 50 in accordance with the principles of the present invention. The face 52 of the panel 50 has a similar configuration to the panel 12 previously discussed with reference to FIGS. 1–2B. That is, the panel 50 is provided with channels 54 for receiving brick units 16 to create a wall of brick. Also like the previous embodiment, the channels 54 are configured to be wider than the width of a standard brick unit 16, such that when the bricks are in place the face 52 of panel 50 has spaces 58. As seen from the figure, space 58 allows irregular-sized brick units 16' to readily fit within channel 54. However, the back side 56 of the panel 50, is configured to match the contour of an existing structure 60. A building will often have an architectural feature 62 that is not desired to be visible. By utilizing the panel 50 of the present invention, a recess 64 can be formed in the panel 50 to substantially match the shape of the architectural feature 62. When the panel 50 is attached to the structure 60, the recess 64 is fitted over the architectural feature 62 to hide that feature. When brick is attached to the face 52 of the panel in a manner previously described, the architectural feature 62 will not be visible.

Figure 4:
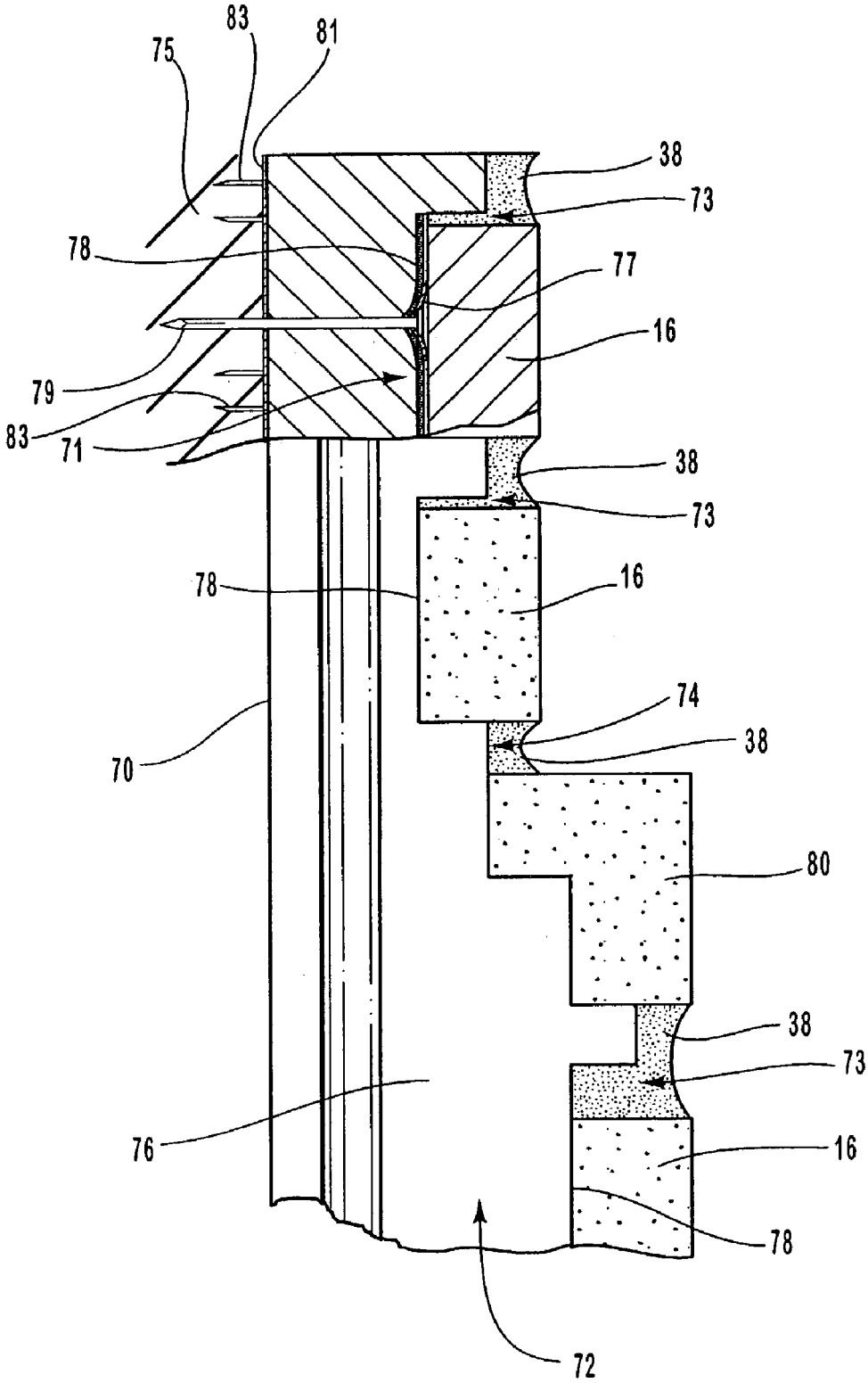
FIG. 4 is a side view of yet another embodiment of a thin brick panel.

In yet another embodiment, FIG. 4 illustrates a panel 70 configured to add an architectural element 72 to an existing structure 75. The panel 70 includes a thicker portion 76 that protrudes an additional amount from the face 74 of the panel 70, such that thin brick units placed thereon protrude from other thin brick units. The panel 70 is configured with channels 78, similar to the other embodiments disclosed herein, to receive brick units 16. Likewise, channels may be made wider than the width of a standard thin brick unit 16, such that space 73 will be formed. However, panel 70 is also configured to receive different shaped brick elements. To illustrate one such shape, the embodiment of FIG. 4 may be configured to receive corner brick unit 80. When applied to panel 70, such a brick unit gives the illusion that the brick units have a standard thickness.

As shown in partial cross-section, the panel 70 may be secured to the structure 75 with a fastener, generally indicated at 71. The fastener 71 will typically be comprised of a washer member 77 and a mechanical fastener 79, such as a nail or a screw. The washer member 77 is preferably disc shaped as shown in FIG. 1 and includes a center aperture for receiving the fastener 79. The size of the washer member 77 will preferably be large enough to provide sufficient surface area on its back side to prevent or significantly reduce the possibility of the washer being pulled through the panel 70. The washer member 77 is held in place by the fastener 79, which is secured to the structure 75 typically by screwing (in the case of a threaded fastener) or hammering (in the case of a nail) the fastener 79 into the structure 75. Moreover, by placing the mesh strips 20 between the washer member 77 and the panel 70 as shown in FIG. 1, the mesh strips 20 will spread the forces of the washer 77 against the panel 70 over a larger surface area to further prevent the washers from being forced through the mesh panel 70.

Such fasteners 71 will often be utilized when the structure or substrate 75 to which the panel 70 is being attached is a wood-type construction. The fasteners 71 are preferably inserted into studs in order to assure a secure attachment. In such an application, the panel 70 is not typically adhesively attached to the structure 75. Instead, a layer of water repellant material 81, such as tar paper, is first attached to the structure as with staples 83. The tar paper may be overlapped to prevent water from seeping between adjacent sections of the tar paper. The panel 70 is then held in place merely by the fasteners 71. By doing so, water that finds its way behind the panel 70 can flow between the back side of the panel 70 and the tar paper 81 without becoming trapped therein between resulting in water damage (i.e., mildew, rotting, etc.) to the structure 75.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A method for forming a wall of thin bricks, comprising the steps of:

providing a panel having a front side and a back side, the front side defining a plurality of laterally extending channels defined by a plurality of laterally extending spacing members, each channel having a substantially flat portion positioned between two of the spacing members, wherein the panel has one or more recesses on the back side, and wherein the one or more recesses are sized and shaped to substantially match the shape of one or more existing architectural features;

applying an adhesive to the channels;

pressing a plurality of thin brick units having a width less than the width of the channels and a thickness greater than the height of the spacing members into the adhesive such that the thin bricks form rows in the channels; and applying mortar to the joints between the rows of thin brick units such that the mortar is in contact with a thin brick unit, an adjacent spacing member, and a part of the substantially flat portion of an adjacent channel.

2. A method for forming a wall of thin bricks, comprising the steps of:

providing a panel having a front side and a back side, the front side defining a plurality of laterally extending channels defined by a plurality of laterally extending spacing members, each channel having a substantially flat portion positioned between two of the spacing members;

applying an adhesive to the channels;

pressing a plurality of thin brick units having a width less than the width of the channels and a thickness greater than the height of the spacing members into the adhesive such that the thin bricks form rows in the channels, wherein the panel has a thicker portion such that thin brick units applied to the thicker portion sit protruded from other thin brick units; and applying mortar to the joints between the rows of thin brick units such that the mortar is in contact with a thin brick unit, an adjacent spacing member, and a part of the substantially flat portion of an adjacent channel.

* * * * *